US011021670B2

(12) United States Patent
Shishikura

(10) Patent No.: US 11,021,670 B2
(45) Date of Patent: Jun. 1, 2021

(54) MIXED GREASE

(71) Applicant: IDEMITSU KOSAN CO., LTD., Chiyoda-ku (JP)

(72) Inventor: Akihiro Shishikura, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 34 days.

(21) Appl. No.: 16/318,494

(22) PCT Filed: Nov. 29, 2017

(86) PCT No.: PCT/JP2017/042839
§ 371 (c)(1),
(2) Date: Jan. 17, 2019

(87) PCT Pub. No.: WO2018/101340
PCT Pub. Date: Jun. 7, 2018

(65) Prior Publication Data

US 2019/0300813 A1 Oct. 3, 2019

(30) Foreign Application Priority Data

Nov. 30, 2016 (JP) ..... JP2016-233156

(51) Int. Cl.
*C10M 169/00* (2006.01)
*C10M 117/04* (2006.01)
(Continued)

(52) U.S. Cl.
CPC ..... *C10M 169/00* (2013.01); *C10M 117/02* (2013.01); *C10M 117/04* (2013.01);
(Continued)

(58) Field of Classification Search
CPC ..... C10M 169/00; C10M 117/04; C10M 117/06; C10M 135/18; C10M 137/105; C10M 141/10
See application file for complete search history.

(56) References Cited

U.S. PATENT DOCUMENTS 4,392,967 A 7/1983 Alexander
4,444,669 A * 4/1984 Wittse, Jr. ..... C10M 117/04 508/512
(Continued)

FOREIGN PATENT DOCUMENTS

JP 58-141298 A 8/1983
JP 4-252296 A 9/1992
(Continued)

OTHER PUBLICATIONS

International Search Report dated Jan. 9, 2018 in PCT/JP2017/042839 filed Nov. 29, 2017.
(Continued)

*Primary Examiner* — Ellen M McAvoy
(74) *Attorney, Agent, or Firm* — Oblon, McClelland, Maier & Neustadt, L.L.P.

(57) ABSTRACT

Provided is a mixed grease containing a grease (A) prepared from a base oil (a1) and a thickening agent (a2) that is a lithium soap consisting of a lithium salt of a monovalent fatty acid, and a grease (B) prepared from a base oil (b1) and a thickening agent (b2) that is a lithium complex soap consisting of a lithium salt of a monovalent fatty acid and a lithium salt of a divalent fatty acid. The mixed grease has good wear resistance and load bearing properties and has excellent grease leakage preventing properties.

20 Claims, 1 Drawing Sheet

(51) Int. Cl.

| | |
|---|---|
| ***C10M 117/06*** | (2006.01) |
| ***C10M 135/18*** | (2006.01) |
| ***C10M 137/10*** | (2006.01) |
| ***C10M 141/10*** | (2006.01) |
| ***C10M 169/06*** | (2006.01) |
| ***C10M 169/02*** | (2006.01) |
| ***C10M 117/02*** | (2006.01) |
| *C10M 137/00* | (2006.01) |
| *C10M 139/00* | (2006.01) |
| *C10N 30/06* | (2006.01) |
| *C10N 40/02* | (2006.01) |
| *C10N 40/04* | (2006.01) |
| *C10N 40/06* | (2006.01) |
| *C10N 50/10* | (2006.01) |

(52) U.S. Cl.

CPC ..... *C10M 117/06* (2013.01); *C10M 135/18* (2013.01); *C10M 137/105* (2013.01); *C10M 141/10* (2013.01); *C10M 169/02* (2013.01); *C10M 169/06* (2013.01); *C10M 137/00* (2013.01); *C10M 139/00* (2013.01); *C10M 2203/003* (2013.01); *C10M 2207/1276* (2013.01); *C10M 2207/1285* (2013.01); *C10M 2219/068* (2013.01); *C10M 2223/047* (2013.01); *C10N 2030/06* (2013.01); *C10N 2040/02* (2013.01); *C10N 2040/04* (2013.01); *C10N 2040/06* (2013.01); *C10N 2050/10* (2013.01)

(56) References Cited

U.S. PATENT DOCUMENTS

| | | | | | |
|---|---|---|---|---|---|
| 4,483,776 | A * | 11/1984 | Witte, Jr. | C10M 117/00 | 508/512 |
| 4,582,619 | A * | 4/1986 | Carley | C10M 117/04 | 508/512 |
| 4,597,881 | A * | 7/1986 | Iseya | C10M 117/00 | 508/512 |
| 4,749,502 | A * | 6/1988 | Alexander | C10M 169/02 | 508/539 |
| 5,391,309 | A * | 2/1995 | Brewster | C10M 117/00 | 508/512 |
| 5,516,439 | A * | 5/1996 | Takeuchi | C10M 135/10 | 508/374 |
| 5,650,380 | A * | 7/1997 | Fletcher | C10M 125/22 | 508/168 |
| 5,783,531 | A * | 7/1998 | Andrew | C10M 169/00 | 508/510 |
| 6,063,742 | A * | 5/2000 | Konzman | C10M 137/10 | 508/368 |
| 6,100,226 | A * | 8/2000 | Konzman | C10M 129/93 | 508/423 |
| 7,829,512 | B2 * | 11/2010 | Stober | B01J 19/1806 | 508/512 |
| 2004/0198612 | A1 | 10/2004 | Asao et al. | | |
| 2004/0266632 | A1 | 12/2004 | Iso | | |
| 2005/0082014 | A1 | 4/2005 | Spagnoli | | |
| 2011/0251113 | A1 | 10/2011 | Daegling | | |
| 2012/0314985 | A1 | 12/2012 | Saita et al. | | |
| 2012/0329695 | A1 * | 12/2012 | Beret | C10M 169/00 | 508/506 |
| 2013/0029888 | A1 * | 1/2013 | Beret | C10M 169/06 | 508/167 |
| 2013/0130953 | A1 * | 5/2013 | Spagnoli | C10M 123/02 | 508/136 |
| 2013/0281331 | A1 * | 10/2013 | Bardin | C10M 141/02 | 508/122 |
| 2014/0045733 | A1 * | 2/2014 | Nogami | C10M 141/12 | 508/100 |
| 2014/0303052 | A1 | 10/2014 | Beatty et al. | | |
| 2015/0148274 | A1 * | 5/2015 | Fagan | C10M 117/04 | 508/186 |
| 2015/0197702 | A1 * | 7/2015 | Bertin | C10M 117/06 | 508/512 |
| 2018/0051227 | A1 * | 2/2018 | E. | C10M 169/045 | |
| 2019/0185780 | A1 * | 6/2019 | Saito | C10M 129/32 | |

FOREIGN PATENT DOCUMENTS

| | | | |
|---|---|---|---|
| JP | 11-302682 | A | 11/1999 |
| JP | 2004-346298 | A | 12/2004 |
| JP | 2009-149901 | A | 7/2009 |
| JP | 2011-42747 | A | 3/2011 |
| JP | 2012-509951 | A | 4/2012 |
| JP | 2014-501816 | A | 1/2014 |

OTHER PUBLICATIONS

Extended European Search Report dated Apr. 17, 2020 in European Patent Application No. 17875964.3, 8 pages.

Japanese Office Action dated Jun. 30, 2020 in Patent Application No. 2016-233156 (with English translation), 6 pages.

Office Action dated Dec. 23, 2020 in European Patent Application No. 17875964.3.

Office Action dated Nov. 27, 2020 in Indian Application No. 201947002032.

* cited by examiner

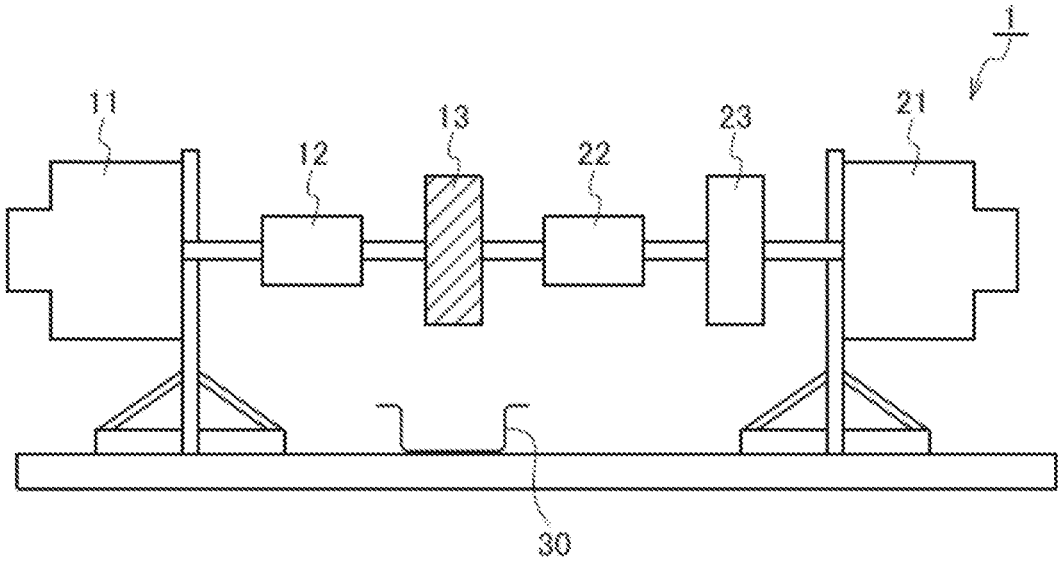
1
11
12
13
22
23
21
30

MIXED GREASE

TECHNICAL FIELD

The present invention relates to a mixed grease.

BACKGROUND ART

For the reason that grease can be readily sealed up as compared with lubricating oil and can reduce size and weight of machines to be lubricated therewith, grease is widely used for lubrication of various slide members of automobiles, electric instrument and various industrial machines.

Recently, grease has become much used in precision reducers that the joint parts of industrial robots and geared motors have.

A precision reducer is composed of plural slide parts and rolling parts, and when a torque is given to the input side thereof, it is transmitted to the output side after the speed thereof is reduced or increased. In the precision reducer, the torque transmission efficiency on the output side is required to be constant. The torque on the output side may readily vary owing to wear of internal members (slide parts, rolling parts), and the damage at the metal contact site between the slide part and the rolling part is desired to be reduced. Consequently, grease for use in precision reducers is desired to have characteristics of wear resistance and load bearing properties.

For example, PTL 1 discloses a grease composition containing a base oil, a thickening agent, a molybdenum thiophosphate and a calcium salt such as calcium sulfonate, for the purpose of providing a grease composition for reducers capable of reducing damages at metal contact sites at high temperatures and capable of prolonging machine lifetime.

CITATION LIST

Patent Literature

PTL 1: JP 2011-042747 A

SUMMARY OF INVENTION

Technical Problem

For example, in equipments for coating, welding or food production, a method of preventing contamination with foreign substances is desired. Consequently, grease for use in a precision reducer that such equipments have is desired to have not only wear resistance and load bearing properties but also grease leakage preventing properties.

When leaked, grease may adhere to or mix, as an impurity, in the products produced in equipments to cause yield reduction and, not limited thereto, grease supply to the metal contact sites between slide parts and rolling parts may reduce owing to grease leakage to cause damage at the metal contact sites.

In particular, in precision reducers that joint parts of industrial robots have, the rotation direction is not constant but always varies, and therefore such precision reducers may be said to be in environments of more readily causing grease leakage from the metal contact sites.

In PTL 1, nothing is discussed relating to such grease leakage preventing properties. Investigations made by the present inventors have revealed that, when the grease composition concretely disclosed in PTL 1 is used in precision reducers that joint parts of industrial robots have, grease leakage frequently occurs.

The present invention has been made in consideration of the above-mentioned problems, and an object thereof is to provide a grease having good wear resistance and load bearing properties and also having excellent grease leakage preventing properties.

Solution to Problem

The present inventors have found that a mixed grease containing a grease prepared using a lithium soap as a thickening agent and a grease prepared using a lithium complex soap can solve the above-mentioned problems and have completed the present invention.

Specifically, the present invention provides the following [1].

[1] A mixed grease containing:

a grease (A) prepared from a base oil (a1) and a thickening agent (a2) that is a lithium soap consisting of a lithium salt of a monovalent fatty acid, and a grease (B) prepared from a base oil (b1) and a thickening agent (b2) that is a lithium complex soap consisting of a lithium salt of a monovalent fatty acid and a lithium salt of a divalent fatty acid.

Advantageous Effects of Invention

The mixed grease of the present invention has good wear resistance and load bearing properties and also has excellent grease leakage preventing properties.

BRIEF DESCRIPTION OF DRAWING

FIG. 1 is a schematic view of a measurement device used in measuring the torque transmission efficiency in Examples.

DESCRIPTION OF EMBODIMENTS

The mixed grease of the present invention contains a grease (A) prepared from a base oil (a1) and a thickening agent (a2) that is a lithium soap consisting of a lithium salt of a monovalent fatty acid, and a grease (B) prepared from a base oil (b1) and a thickening agent (b2) that is a lithium complex soap consisting of a lithium salt of a monovalent fatty acid and a lithium salt of a divalent fatty acid.

Basically, the mixed grease of the present invention is one prepared by mixing the grease (A) and the grease (B).

In general, when 2 or more kinds of greases are mixed, the properties that each grease has may worsen in many cases, that is, such mixing could not provide any synergistic effect, and owing to the common general technical knowledge based on such understandings taken between those skilled in the art, mixing of greases is generally not carried out. In addition, because of the point that, different from a lubricating oil that is liquid, an operation of mixing 2 or more kinds of semi-solid greases often lower the productivity, another reason is that 2 or more kinds of greases are not generally mixed.

Among such common general technical knowledge taken between those skilled in the art, the present inventors have made various investigations relating to greases capable of improving grease leakage preventing properties while maintaining good wear resistance and load bearing properties.

Through such investigations, the present inventors have found that the mixed grease prepared by combining the above-mentioned specific two kinds of greases can improve these characteristics.

The mixed grease of one embodiment of the present invention may further contain various additives that are used in ordinary greases.

In one embodiment of the present invention, various additives may be blended in preparing the grease (A) and/or the grease (B) or in mixing the grease (A) and the grease (B).

In the mixed grease of one embodiment of the present invention, the total amount of the base oil (a1) and the thickening agent (a2) constituting the grease (A), and the base oil (b1) and the thickening agent (b2) constituting the grease (B) is, based on the total amount (100% by mass) of the mixed grease, preferably 70% by mass or more, more preferably 75% by mass or more, even more preferably 80% by mass or more, still more preferably 85% by mass or more, and is generally 100% by mass or less, preferably 99.9% by mass or less, more preferably 99% by mass or less, even more preferably 95% by mass or less.

<Greases (A), (B)>

The grease (A) for use in the present invention is a grease prepared from a base oil (a1) and a thickening agent (a2) that is a lithium soap consisting of a lithium salt of a monovalent fatty acid.

The grease (B) is a grease prepared from a base oil (b1) and a thickening agent (b2) that is a lithium complex soap consisting of a lithium salt of a monovalent fatty acid and a lithium salt of a divalent fatty acid.

In preparing the greases (A) and (B), various additives for grease may be blended.

In the mixed grease of one embodiment of the present invention, from the viewpoint of providing a mixed grease having bettered wear resistance and load bearing properties and having increased torque transmission efficiency, the content ratio of the grease (A) to the grease (B) [(A)/(B)] is, as a ratio by mass, preferably 60/40 or more, more preferably 70/30 or more, even more preferably 80/20 or more, still more preferably 85/15 or more, and especially preferably 90/10 or more.

From the viewpoint of providing a mixed grease having bettered grease leakage preventing properties, the content ratio of the grease (A) to the grease (B) [(A)/(B)] is, as a ratio by mass, preferably 99/1 or less, more preferably 97.5/2.5 or less, even more preferably 97/3 or less.

In the mixed grease of one embodiment of the present invention, from the viewpoint of providing a mixed grease having bettered wear resistance and load bearing properties and having increased torque transmission efficiency, the content of the grease (A) is, based on the total amount (100% by mass) of the mixed grease, preferably 60% by mass or more, more preferably 65% by mass or more, even more preferably 72% by mass or more, still more preferably 77% by mass or more, and especially preferably 82% by mass or more.

From the viewpoint of providing a mixed grease having bettered grease leakage preventing properties, the content of the grease (A) is, based on the total amount (100% by mass) of the mixed grease, preferably 97.5% by mass or less, more preferably 95% by mass or less, even more preferably 93% by mass or less.

In the mixed grease of one embodiment of the present invention, from the viewpoint of providing a mixed grease having bettered grease leakage preventing properties, the content of the grease (B) is, based on the total amount (100% by mass) of the mixed grease, preferably 2.5% by mass or more, more preferably 2.7% by mass or more, even more preferably 3.0% by mass or more.

Also from the viewpoint of providing a mixed grease having bettered wear resistance and load bearing properties and having high torque transmission efficiency, the content of the grease (B) is, based on the total amount (100% by mass) of the mixed grease, preferably 30% by mass or less, more preferably 25% by mass or less, even more preferably 18% by mass or less, still more preferably 13% by mass or less, and especially more preferably 9% by mass or less.

The base oils (a1) and (b1) and the thickening agents (a2) and (b2) to be used in preparing the greases (A) and (B) and contained in the greases (A) and (B) are described in detail hereinunder.

[Base Oils (a1) and (b1)]

The base oils (a1) and (b1) to be used in preparing the greases (A) and (B) and contained in the greases (A) and (B) may be one or more selected from mineral oils and synthetic oils.

Examples of the mineral oil include distillates obtained through atmospheric distillation or reduced-pressure distillation of crude oils selected from paraffin-base crude oils, intermediate-base crude oils and naphthene-base crude oils, and purified oils obtained by purifying the distillates according to ordinary methods, specifically, solvent-refined oils, hydrorefined oils, dewaxed oils, and clay-treated oils. In addition, a mineral wax obtained by isomerizing a wax produced through Fischer-Tropsch synthesis (GTL wax, gas to liquid wax) is also usable here.

Examples of the synthetic oil include hydrocarbon oils, aromatic oils, ester oils, and ether oils.

Examples of the hydrocarbon oils include poly-α-olefins (PAOs) such as polybutene, polyisobutylene, 1-decene oligomer, and 1-decene/ethylene cooligomer, and hydrogenated products thereof.

Examples of the aromatic oil include alkylbenzenes such as monoalkylbenzenes, and dialkylbenzenes; and alkylnaphthalenes such as monoalkylnaphthalenes, dialkylnaphthalenes, and polyalkylnaphthalenes.

The ester oil includes diester oils such as dibutyl sebacate, cli-2-ethylhexyl sebacate, dioctyl adipate, diisodecyl adipate, ditridecyl adipate, ditridecyl glutarate, and methylacetyl ricinolate; aromatic ester oils such as trioctyl trimellitate, tridecyl trimellitate, and tetraoctyl pyromellitate; polyol ester oils such as trimethylolpropane caprylate, trimethylolpropane pelargonate, pentaerythritol 2-ethylhexanoate, and pentaerythritol pelargonate; and complex ester oils such as oligoesters of a polyalcohol and a mixed fatty acid of a dibasic acid and a monobasic acid.

Examples of the ether oil include polyglycols such as polyethylene glycol, polypropylene glycol, polyethylene glycol monoether, and polypropylene glycol monoether; and phenyl ether oils such as monoalkyltriphenyl ether, alkykliphenyl ether, dialkyldiphenyl ether, pentaphenyl ether, tetraphenyl ether, monoalkyltetraphenyl ether, and dialkyltetraphenyl ether.

The kinematic viscosity at 40° C. of the base oils (a1) and (b1) for use in one embodiment of the present invention is each independently preferably 10 to 500 $mm^2/s$, but is, from the viewpoint of providing a mixed grease having more bettered grease leakage preventing properties, more preferably 12 to 200 $mm^2/s$, even more preferably 15 to 150 $mm^2/s$, further more preferably 20 to 120 $mm^2/s$, and still more preferably 25 to 90 $mm^2/s$.

Especially from the viewpoint of providing a mixed grease having more bettered grease leakage preventing properties, the kinematic viscosity at 40° C. of the base oil (a1) is preferably 200 $mm^2/s$ or less (more preferably 150 $mm^2/s$ or less, even more preferably 120 $mm^2/s$ or less, still more preferably 90 $mm^2/s$ or less).

For the base oils (a1) and (b1), a high-viscosity base oil and a low-viscosity base oil may be combined to give a mixed base oil having a kinematic viscosity controlled to fall within the above-mentioned range for use herein.

The viscosity index of the base oils (a1) and (b1) for use in one embodiment of the present invention is each independently preferably 60 or more, more preferably 70 or more, even more preferably 80 or more, and further more preferably 100 or more.

In this description, the kinematic viscosity and the viscosity index are values measured and calculated according to JIS K2283:2003.

[Thickening Agent (a2)]

In the present invention, the thickening agent (a2) to be used in preparing the grease (A) and contained in the grease (A) is a lithium soap of a lithium salt of a monovalent fatty acid.

Examples of the monovalent fatty acid to constitute the lithium salt of a monovalent fatty acid include lauric acid, tridecylic acid, myristic acid, pentadecylic acid, palmitic acid, margaric acid, stearic acid, nonadecylic acid, arachiclic acid, behenic acid, lignoceric acid, tallow acid, 9-hydroxystearic acid, 10-hydroxystearic acid, 12-hydroxystearic acid, 9,10-hydroxystearic acid, ricinolic acid, and ricinoelaidic acid.

Among these, the monovalent fatty acid is preferably a monovalent saturated fatty acid having 12 to 24 carbon atoms (preferably having 12 to 18, more preferably 14 to 18 carbon atoms), more preferably stearic acid, 9-hydroxystearic acid, 10-hydroxystearic acid, or 12-hydroxystearic acid, and even more preferably stearic acid or 12-hydroxystearic acid.

In one embodiment of the present invention, the average aspect ratio of the thickening agent (a2) in the grease (A) is, from the viewpoint of improving grease leakage preventing properties and from the viewpoint of increasing torque transmission efficiency, preferably 30 or more, more preferably 50 or more, even more preferably 100 or more, further more preferably 200 or more, still further more preferably 300 or more, and especially more preferably 350 or more.

The upper limit of the average aspect ratio of the thickening agent (a2) is, though not specifically limited, generally 50,000 or less, more preferably 10,000 or less, even more preferably 5,000 or less.

In this description, the "aspect ratio" is a ratio of "length" to "thickness" [length/thickness] of the target thickening agent.

Regarding the "thickness" of the thickening agent, the target thickening agent is cut vertically to the tangential direction at an arbitrary point on the side face thereof, and when the thus-cut section is a circle or an oval, the thickness is the diameter or the major axis of the circle or the oval, but when the section is a polygon, the thickness is the diameter of the circumscribing circle of the polygon.

The "length" of the thickening agent is a distance between the remotest points of the target thickening agent.

In this description, for example, in the case where the aspect ratio of a part of the target thickening agent is confirmed to be X or more, it may be considered that "the aspect ratio of the target thickening agent is X or more". Accordingly, it is not always necessary to specify the total length of the target thickening agent.

Also in this description, the aspect ratio of the thickening agent may be determined, for example, by applying a hexane dilution of a target grease to a collodion film-coated copper mesh and observing it with a transmission electron microscope (TEM) at a magnification of 3,000 to 20,000 powers.

The image in observation with TEM is taken, and on the image, the thickness and the length of the thickening agent are measured, and the aspect ratio may be calculated from the resultant data.

In this description, an average of the data of the aspect ratio of 10 to 100 pieces of the thickening agent that have been arbitrarily selected may be considered to be the "average aspect ratio" of the thickening agent.

The content ratio [(a2)/(a1)] of the thickening agent (a2) to the base oil (a1) contained in the grease (A) for use in one embodiment of the present invention is, as a ratio by mass, preferably 1/99 to 15/85, more preferably 2/98 to 12/88, even more preferably 3/97 to 10/90.

[Thickening Agent (b2)]

In the present invention, as the thickening agent (a2) to be used in preparing the grease (B) and contained in the grease (B), a thickening agent (b2) that is a lithium complex soap consisting of a lithium salt of a monovalent fatty acid and a lithium salt of a divalent fatty acid is used.

The monovalent fatty acid to constitute the lithium salt of a monovalent fatty acid may be the same as the monovalent fatty acid to constitute the lithium soap (a lithium salt of a monovalent fatty acid) for use as the above-mentioned thickening agent (a2).

Among these, the monovalent fatty acid is preferably a monovalent saturated fatty acid having 12 to 24 (preferably 12 to 18, more preferably 14 to 18) carbon atoms, more preferably stearic acid, 9-hydroxystearic acid, 10-hydroxystearic acid or 12-hydroxystearic acid, and even more preferably stearic acid or 12-hydroxystearic acid.

Examples of the divalent fatty acid to constitute the lithium salt of a divalent fatty acid include succinic acid, malonic acid, glutaric acid, adipic acid, pimelic acid, suberic acid, azelaic acid, and sebacic acid.

Among these, the divalent fatty acid is preferably azelaic acid or sebacic acid, more preferably azelaic acid.

In one embodiment of the present invention, the thickening agent (a2) is preferably a lithium complex soap that is a mixture of a lithium salt of stearic acid or 12-hydroxystearic acid and a lithium salt of azelaic acid.

In one embodiment of the present invention, the average aspect ratio of the thickening agent (b2) in the grease (B) is, from the viewpoint of bettering grease leakage preventing properties and from the viewpoint of increasing torque transmission efficiency, preferably 30 or more, more preferably 50 or more, even more preferably 100 or more, still more preferably 200 or more, and especially preferably 300 or more.

The upper limit of the average aspect ratio of the thickening agent (b2) is not specifically limited but is generally 50,000 or less, more preferably 10,000 or less, even more preferably 5,000 or less.

The content ratio [(b2)/(b1)] of the thickening agent (b2) to the base oil (b1) contained in the grease (B) for use in one embodiment of the present invention is, from the viewpoint of bettering grease leakage preventing properties and from the viewpoint of increasing torque transmission efficiency, and as a ratio by mass, preferably 5/95 to 30/70, more preferably 8/92 to 25/75, even more preferably 10/90 to 20/80, still more preferably 10/90 to 16/84.

<Various Additives>

The mixed grease of one embodiment of the present invention may contain, within a range not detracting from the advantageous effects of the present invention, various additives for use in ordinary greases.

Such various additives may be mixed in the process of preparing the grease (A) and/or the grease (B).

Examples of various additives include an extreme pressure agent, a rust inhibitor, an antioxidant, a lubrication promoter, a thickening agent, modifier, detergent-dispersant, a corrosion inhibitor, an anti-foaming agent, and a metal deactivator.

One alone of these various additives may be used singly or two or more kinds thereof may be used in combination.

The content of each additive in the mixed grease of one embodiment of the present invention may be suitably set depending on the kind of the additive, but is, based on the total amount (100% by mass) of the mixed grease, preferably 0.01 to 20% by mass, more preferably 0.1 to 15% by mass, even more preferably 0.2 to 12% by mass.

Among these various additives, the mixed grease of one embodiment of the present invention preferably contains an extreme pressure agent, more preferably one or more extreme pressure agents selected from a molybdenum-based extreme pressure agent, a phosphorus-based extreme pressure agent and a sulfur/phosphorus-based extreme pressure agent.

Examples of the molybdenum-based extreme pressure agent include inorganic molybdenum compounds such as metal molybdates such as sodium molybdate, potassium molybdate, lithium molybdate, magnesium molybdate and calcium molybdate, and molybdenum disulfide; and organic molybdenum compounds such as molybdenum dialkyl dithiocarbamates (MoDTC), molybdenum dialkyldithiophosphates (MoDTP) and molybdic acid amine salts.

Among these, organic molybdenum compounds are preferred, and molybdenum dialkyldithiophosphates (MoDTP) and molybdenum dialkyl dithiocarbamates (MoDTC) are more preferred.

Examples of the phosphorus-based extreme pressure agent include phosphates such as aryl phosphates, alkyl phosphates, alkenyl phosphates, and alkylaryl phosphates; acid phosphates such as monoaryl acid phosphates, diaryl acid phosphates, monoalkyl acid phosphates, dialkyl acid phosphates, monoalkenyl acid phosphates, and dialkenyl acid phosphates; phosphites such as aryl hydrogenphosphites, alkyl hydrogenphosphites, aryl phosphites, alkyl phosphites, alkenyl phosphites, and arylalkyl phosphites; acid phosphites such as monoalkyl acid phosphites, dialkyl acid phosphites, monoalkenyl acid phosphites, and dialkenyl acid phosphites; and amine salts thereof.

Examples of the sulfur/phosphorus-based extreme pressure agent include alkyl thiophosphates, dialkyl dithiophosphates, trialkyl trithiophosphates, and amine salts thereof.

Among these, dialkyl dithiophosphates are preferred.

The content of the extreme pressure agent in the mixed grease of one embodiment of the present invention is, based on the total amount of the mixed grease (100% by mass), preferably 0.01 to 20% by mass, more preferably 0.1 to 15% by mass, even more preferably 0.2 to 12% by mass.

Within a range not detracting from the advantageous effects of the present invention, the mixed grease of one embodiment of the present invention may contain any other thickening agent not corresponding to the thickening agents (a2) and (b2), but the content of the other thickening agent is preferably as small as possible.

The content of the other thickening agent is preferably 0 to 20 parts by mass relative to the total amount, 100 parts by mass of the thickening agents (a2) and (b2) contained in the mixed grease, more preferably 0 to 10 parts by mass, even more preferably 0 to 5 parts by mass, further more preferably 0 to 1 part by mass.

From the viewpoint of an environmental aspect and safety, the mixed grease of one embodiment of the present invention does not substantially contain a urea-based thickening agent.

In this description, the wording "does not substantially contain a urea-based thickening agent" means a definition to exclude "intentionally blending a urea-based thickening agent" and is not a definition to exclude a urea-based thickening agent that may be contained as an impurity.

The content of the urea-based thickening agent is generally less than 5 parts by mass based on the total amount, 100 parts by mass of the thickening agents (a2) and (b2) contained in the mixed grease, preferably less than 1 part by mass, more preferably less than 0.1 parts by mass, even more preferably less than 0.01 parts by mass and further more preferably less than 0.001 parts by mass.

[Method for Preparing Grease (A)]

For preparing the grease (A), any known method is employable, but from the viewpoint of obtaining a grease (A) containing a thickening agent (a2) having an average aspect ratio of 30 or more, a method including the following steps (1A) to (3A) is preferred.

Step (1A): a step of adding a monovalent fatty acid to a base oil (a1) and dissolving it therein, and further adding thereto an equivalent of lithium hydroxide to prepare a solution of the raw material.

Step (2A): a step of reacting the monovalent fatty acid and lithium hydroxide at a reaction temperature of 180 to 220 GC, while stirring the solution obtained in the step (1A) at a rotation speed of 20 to 70 rpm.

Step (3A): a step of cooling the solution after the step (2A) at a cooling rate of 0.05 to 0.6° C./min.

(Step (1A))

The step (1A) is a step of adding a monovalent fatty acid to a base oil (a1) and dissolving it therein, and further adding thereto an equivalent of lithium hydroxide to prepare a solution of the raw material.

In this step, from the viewpoint of dissolving a monovalent fatty acid in a base oil (a1), preferably, the base oil (a1) is heated up to 70 to 100° C. (preferably 80 to 95° C., more preferably 85 to 95° C.) before and after adding the monovalent fatty acid thereto.

Also preferably, lithium hydroxide is, in the form of an aqueous solution of lithium hydroxide dissolved in water, added to a solution containing a monovalent fatty acid.

In the case where lithium hydroxide is added in the form of an aqueous solution thereof, preferably, the solution after mixed with the aqueous solution is heated up to 100° C. or higher for removing water from the solution through evaporation.

(Step (2A))

The step (2A) is a step of reacting the monovalent fatty acid and lithium hydroxide at a reaction temperature of 180 to 220° C., while stirring the solution obtained in the step (1A) at a rotation speed of 20 to 70 rpm.

The rotation speed in stirring the solution in this step is, from the viewpoint of controlling the average aspect ratio of the thickening agent (a2) to be 30 or more, preferably 20 to 70 rpm, more preferably 30 to 60 rpm, even more preferably 40 to 50 rpm.

The reaction temperature in this step is preferably 180 to 220° C., more preferably 190 to 210° C., even more preferably 195 to 205° C.

(Step (3A))

The step (3A) is a step of cooling the solution after the step (2A) at a cooling rate of 0.05 to 0.6° C./min.

The cooling rate in this step is, from the viewpoint of controlling the average aspect ratio of the thickening agent (a2) to be 30 or more, preferably 0.05 to 0.6° C./min, more preferably 0.05 to 0.3° C./min, even more preferably 0.05 to 0.2° C./min.

Also in this step, the temperature of the reaction product (grease) after cooling is preferably 25 to 140° C., more preferably 40 to 120° C., even more preferably 50 to 90° C.

In this step, various additives for grease may be blended and mixed in the reaction product (grease) after cooled. The mixing temperature is preferably 140° C. or lower, more preferably 120° C. or lower, even more preferably 90° C. or lower.

Also in this step, the reaction product (grease) after cooled is preferably milled using a colloid mill and a roll mill or the like.

The temperature of the reaction product (grease) in milling treatment is preferably 140° C. or lower, more preferably 120° C. or lower, even more preferably 90° C. or lower.

[Method for Preparing Grease (B)]

For preparing the grease (B), any known method is employable, but from the viewpoint of obtaining a grease (B) that contains a thickening agent (b2) having an average aspect ratio of 30 or more, a method including the following steps (1B) to (3B) is preferred.

Step (1B): a step of adding a monovalent fatty acid and a divalent fatty acid to a base oil (b1) and dissolving them therein, and further adding thereto an equivalent of lithium hydroxide to prepare a solution of the raw material.

Step (2B): a step of reacting the monovalent fatty acid and lithium hydroxide and the divalent fatty acid and lithium hydroxide at a reaction temperature of 170 to 230° C., while stirring the solution obtained in the step (1B) at a rotation speed of 20 to 70 rpm.

Step (3B): a step of cooling the solution after the step (2B) at a cooling rate of 0.05 to 0.6° C./min.

(Step (1B))

The step (1B) is a step of adding a monovalent fatty acid and a divalent fatty acid to a base oil (b1) and dissolving them therein, and further adding thereto an equivalent of lithium hydroxide to prepare a solution of the raw material.

In this step, from the viewpoint of dissolving a monovalent fatty acid and a divalent fatty acid in a base oil (b1), preferably, the base oil (b1) is heated up to 70 to 100° C. (preferably 80 to 95° C., more preferably 85 to 95° C.) before and after adding the monovalent fatty acid and the divalent fatty acid thereto.

Also preferably, lithium hydroxide is, in the form of an aqueous solution of lithium hydroxide dissolved in water, added to a solution containing a monovalent fatty acid and a divalent fatty acid.

In the case where lithium hydroxide is added in the form of an aqueous solution thereof, preferably, the solution after mixed with the aqueous solution is heated up to 100° C. or higher for removing water from the solution through evaporation.

(Step (2B))

The step (2B) is a step of reacting the monovalent fatty acid and lithium hydroxide and the divalent fatty acid and lithium hydroxide at a reaction temperature of 170 to 230° C., while stirring the solution obtained in the step (1B) at a rotation speed of 20 to 70 rpm.

The rotation speed in stirring the solution in this step is, from the viewpoint of controlling the average aspect ratio of the thickening agent (b2) to be 30 or more, preferably 20 to 70 rpm, more preferably 30 to 60 rpm, even more preferably 40 to 50 rpm.

The reaction temperature in this step is preferably 170 to 230° C., more preferably 180 to 220° C., even more preferably 190 to 210° C.

(Step (3B))

The step (3B) is a step of cooling the solution after the step (2B) at a cooling rate of 0.05 to 0.6° C./min.

The cooling rate in this step is, from the viewpoint of controlling the average aspect ratio of the thickening agent (b2) to be 30 or more, preferably 0.05 to 0.6° C./min, more preferably 0.05 to 0.3° C./min, even more preferably 0.05 to 0.2° C./min.

Also in this step, the temperature of the reaction product (grease) after cooling is preferably 25 to 140° C., more preferably 40 to 120° C., even more preferably 50 to 90° C.

In this step, various additives for grease may be blended and mixed in the reaction product (grease) after cooled. The mixing temperature is preferably 140° C. or lower, more preferably 120° C. or lower, even more preferably 90° C. or lower.

Also in this step, the reaction product (grease) after cooled is preferably milled using a colloid mill and a roll mill or the like.

The temperature of the reaction product (grease) in milling treatment is preferably 140° C. or lower, more preferably 120° C. or lower, even more preferably 90° C. or lower.

[Method for Producing Mixed Grease]

A method for producing the mixed grease of the present invention is not specifically limited and, for example, herein employable is a method of blending the greases (A) and (B) previously prepared according to the methods mentioned above, and optionally various additives each in a predetermined amount, and mixing them at room temperature.

Regarding the mixing method after blending the components, the components may be mixed according to a known batch process or continuous mixing process.

[Characteristics of Mixed Grease of Invention]

The worked penetration at 25° C. of the mixed grease of one embodiment of the present invention is, from the viewpoint of controlling the stiffness of the mixed grease to fall within a suitable range and from the viewpoint of bettering torque characteristics and wear resistance, preferably 310 to 430, more preferably 320 to 420, even more preferably 330 to 410, further more preferably 350 to 400.

In this description, the worked penetration means a value measured at 25° C. according to ASTM D 217.

The kinematic viscosity at 40° C. of the liquid component contained in the mixed grease of one embodiment of the present invention is preferably 10 to 200 $mm^2/s$, more preferably 15 to 180 $mm^2/s$, even more preferably 20 to 150 $mm^2/s$, still more preferably 25 to 120 $mm^2/s$, and especially preferably 40 to 105 $mm^2/s$.

In this description, the "liquid component in the mixed grease" means a component that is extracted through centrifugation and is liquid at ordinary temperature. The condition for centrifugation is as mentioned in the section of Examples.

When the mixed grease of one embodiment of the present invention is tested using a four-ball tester according to ASTM D2783, at a load of 392 N and a rotation speed of 1,200 rpm, at an oil temperature of 75° C. and for a test period of 60 minutes, the Shell wear amount thereof is preferably 0.70 mm or less, more preferably 0.60 mm or less, even more preferably 0.50 mm or less.

When the mixed grease of one embodiment of the present invention is tested using a four-ball tester according to ASTM D2783, at a rotation speed of 1,800 rpm, and at an oil temperature of 18.3 to 35.0° C., the weld load (WL) thereof is preferably 2,000 N or more, more preferably 2,200 N or more, even more preferably 2,400 N or more.

The Shell wear amount and the weld load (WL) each mean a value measured according to the methods described in the section of Examples.

The torque transmission efficiency, as measured and calculated according to the method described in the section of Examples given hereinunder, of the mixed grease of one embodiment of the present invention is preferably 70% or more, more preferably 80% or more, even more preferably 85% or more, and further more preferably 90% or more.

The grease leakage ratio, as measured and calculated according to the method described in the section of Examples given hereinunder, of the mixed grease of one embodiment of the present invention is preferably less than 2.0%, more preferably 1.7% or less, even more preferably 1.2% or less, and further more preferably 0.5% or less.

[Use of Mixed Grease of Invention]

The mixed grease of the present invention has good wear resistance and load bearing properties and has excellent grease leakage preventing properties.

Consequently, the mixed grease of the present invention can be favorably used for precision reducers that are equipped in devices for coating, welding or food production or in industrial robots.

Namely, the precision reducers using the mixed grease of the present invention hardly cause grease leakage, and therefore can prevent adhesion or intrusion of foreign materials into products, can readily secure a sufficient grease supply amount in metal contact sites and can prevent metal contact sites from being damaged.

In addition, the mixed grease of the present invention is applicable not only to precision reducers but also to bearing and gears.

More specifically, the mixed grease is favorably usable in various bearings such as slide bearings, antifriction bearings, oil retaining bearings and fluid bearings, and in gears, internal combustion engines, brakes, parts of torque transmission devices, fluid couplings, parts of compression devices, chains, parts of hydraulic systems, parts of vacuum pump devices, watch components, hard disc components, parts of refrigerators, parts of cutting machines, parts of rolling machines, parts of drawbenches, parts of rolling tools, parts of forging machines, parts of heat treating machines, parts of heat carriers, parts of cleaning components, parts of shock absorbers, and parts of sealing machines.

EXAMPLES

Next, the present invention is described in more detail with reference to Examples, but the present invention is not whatsoever restricted by these Examples. Various physical properties were measured according to the measurement methods mentioned below.

(1) 40° C. Kinematic Viscosity, Viscosity Index

Measured and calculated according to JIS K2283:2003.

(2) Average Aspect Ratio of Thickening Agent

A hexane dilution of a target grease was applied to a collodion film-coated copper mesh and observed with a transmission electron microscope (TEM) at a magnification of 6,000 powers to take an image.

In the resultant image, arbitrarily selected 100 pieces of the thickening agent were analyzed to measure the thickness and the length, and an aspect ratio [length/thickness] of each piece was then calculated. An average of the thus-measured data of the aspect ratio of 100 pieces of the thickening agent is referred to as "average aspect ratio" of the thickening agent contained in the target grease.

(3) Worked Penetration

Measured at 25° C. according to ASTM D 217.

Production Examples 1 to 4 (Production of Greases (α1) to (α4))

In a production tank having a volume of 60 L, 12-hydroxystearic acid was added to a mineral oil (40° C. kinematic viscosity: 31 $mm^2/s$, viscosity index: 115) corresponding to a viscosity grade VG30 according to the definition in ISO 3448 or a mineral oil (40° C. kinematic viscosity: 410 $mm^2/s$, viscosity index: 105) corresponding to VG400 in the blending amount shown in Table 1, and dissolved by heating up to 90° C.

An aqueous solution containing lithium hydroxide in the blending amount (solid content) shown in Table 1 was added to the above, and heated up to 100° C. to remove water through evaporation.

After removal of water, this was heated up to 200° C., and stirred at the rotation speed shown in Table 1 to continue the reaction.

After the reaction, this was cooled from 200° C. down to 80° C. at a cooling rate of 0.1° C./min, and then milled twice with a three-roll mill to give any of greases (α1) to (α4).

Regarding the greases (α1) to (α4), the content of the thickening agent, the average aspect ratio of the thickening agent, and the worked penetration are shown in Table 1.

TABLE 1

| | | | Production Example 1 Grease (α1) | Production Example 2 Grease (α2) | Production Example 3 Grease (α3) | Production Example 4 Grease (α4) |
|---|---|---|---|---|---|---|
| Raw Material Formulation | 12-Hydroxystearic acid | part by mass | 4.06 | 4.06 | 4.06 | 4.06 |
| | Lithium hydroxide | part by mass | 0.61 | 0.61 | 0.61 | 0.61 |
| | VG30 mineral oil | part by mass | 95.33 | 95.33 | 95.33 | — |
| | VG400 mineral oil | part by mass | — | — | — | 95.33 |
| | Total | part by mass | 100.00 | 100.00 | 100.00 | 100.00 |

TABLE 1-continued

| | | | Production Example 1 Grease (α1) | Production Example 2 Grease (α2) | Production Example 3 Grease (α3) | Production Example 4 Grease (α4) |
|---|---|---|---|---|---|---|
| Production Condition | Reaction temperature | ° C. | 200 | 200 | 200 | 200 |
| | Rotation speed | rpm | 45 | 55 | 75 | 45 |
| | Cooling rate | ° C./min | 0.1 | 0.1 | 0.1 | 0.1 |
| Content of Thickening Agent in Grease | | % by mass | 4.61 | 4.61 | 4.61 | 4.61 |
| Average Aspect Ratio of Thickening Agent | | — | 482 | 176 | 24 | 395 |
| Worked Penetration | | — | 380 | 380 | 380 | 380 |

Production Examples 5 to 7 (Production of Greases (β1) to (β3))

In a production tank having a volume of 60 L, 12-hydroxystearic acid and azelaic acid were added to a mineral oil (40° C. kinematic viscosity: 31 $mm^2/s$, viscosity index: 115) corresponding to a viscosity grade VG30 according to the definition in ISO 3448 or a mineral oil (40° C. kinematic viscosity: 410 $mm^2/s$, viscosity index: 105) corresponding to VG400 in the blending amount shown in Table 2, and dissolved by heating up to 90° C.

An aqueous solution containing lithium hydroxide in the blending amount (solid content) shown in Table 2 was added to the above, and heated up to 100° C. to remove water through evaporation.

After removal of water, this was heated up to 195° C., and stirred at the rotation speed shown in Table 2 to continue the reaction.

After the reaction, while the same mineral oil as above was added thereto as a cooling oil, this was cooled from 195° C. down to 80° C. at a cooling rate of 0.1° C./min, and then milled twice with a three-roll mill to give any of greases (β1) to (β3).

Regarding the greases (β1) to (β3), the content of the thickening agent, the average aspect ratio of the thickening agent, and the worked penetration are shown in Table 2.

The resultant mixed greases were evaluated as follows. The results are shown in Tables 3 and 4.

(1) Worked Penetration of Mixed Grease

Measured at 25° C. according to ASTM D 217.

(2) 40° C. Kinematic Viscosity of Liquid Component in Mixed Grease

After prepared, the mixed grease was centrifuged (rotation speed: 15,000 rpm, rotation time: 15 hours) to extract the liquid component therefrom, and the kinematic viscosity at 40° C. of the liquid component was measured.

(3) Wear Resistance Test (Shell Wear Test)

According to ASTM D2783, the mixed grease was tested with a four-ball tester under a load of 392 N, at a rotation speed of 1,200 rpm, at an oil temperature of 75° C. and for a test period of 60 minutes. An average value of the wear tracks of three ½-inch balls was calculated as "Shell wear amount". A small value means better wear resistance.

(4) Load Bearing Test (Shell EP Test)

According to ASTM D2783, the mixed grease was tested with a four-ball tester at a rotation speed of 1,800 rpm and at an oil temperature of 18.3 to 35.0° C. to determine the weld load (WL) thereof. A larger value means better load bearing properties.

(5) Torque Transmission Efficiency

FIG. 1 is a schematic view of an apparatus used in measuring the torque transmission efficiency in Examples.

TABLE 2

| | | | Production Example 5 Grease (β1) | Production Example 6 Grease (β2) | Production Example 7 Grease (β3) |
|---|---|---|---|---|---|
| Raw Material Formulation | 12-Hydroxystearic acid | part by mass | 6.00 | 6.00 | 12.00 |
| | Azelaic acid | part by mass | 3.00 | 3.00 | 6.00 |
| | Lithium hydroxide | part by mass | 2.24 | 2.24 | 4.48 |
| | VG30 mineral oil | part by mass | 88.76 | — | 77.52 |
| | VG400 mineral oil | part by mass | — | 88.76 | — |
| | Total | part by mass | 100.00 | 100.00 | 100.00 |
| Production Condition | Reaction temperature | ° C. | 195 | 195 | 195 |
| | Rotation speed | rpm | 45 | 45 | 55 |
| | Cooling rate | ° C./min | 0.1 | 0.1 | 0.1 |
| Content of Thickening Agent in Grease | | % by mass | 11.24 | 11.24 | 22.48 |
| Average Aspect Ratio of Thickening Agent | | — | 372 | 321 | 134 |
| Worked Penetration | | — | 370 | 370 | 370 |

Examples 1 to 9, Comparative Examples 1 to 6

The grease of (α1) to (α4) and (β1) to (β3) obtained in Production Examples 1 to 7, and an extreme pressure agent (mixture of molybdenum dialkyl clithiocarbamate (MoDTC) and dialkyl clithiophosphate) were added to a reactor and mixed at room temperature (25° C.) to prepare mixed greases.

The measurement device 1 shown in FIG. 1 has an input side motor part 11, an input side torque measuring unit 12, an input side reducer 13 (by Nabtesco Corporation, trade name "RV-42N"), an output side torque meter 22, an output side reducer 23 (by Nabtesco Corporation, trade name "RV-125V") and an output side motor part 21 connected in that order.

In the grease filling case (case inside temperature: 30° C.) of the input side reducer 13 of the measurement device 1 of FIG. 1, 285 mL of a mixed grease was filled, then the measurement device 1 was driven under the condition of a load torque of 412 Nm and a rotation speed of 15 rpm, and the rotation speed and the torque on the input side and the output side were measured. According to the following equation, the torque transmission efficiency was calculated.

[Torque Transmission Efficiency (%)]=[Output Side Torque (Nm)]/[Input Side Torque (Nm)]×100 (%)

(6) Grease Leakage Preventing Properties

Using the measurement device 1 shown in FIG. 1, as used in measurement of torque transmission efficiency, 285 mL (270.75 g) of a mixed grease was filled in the grease filling case (case inside temperature: 60° C.) of the input side reducer 13. After filling, the measurement device 1 was driven under the condition of a load torque of 1030 Nm and a rotation speed of 15 rpm, and the grease having leaked from the input side reducer 13 during driving was collected in a tray 30 arranged below the input side reducer 13.

After the measurement device 1 was driven for 280 hours, the "leaked grease amount" collected in the tray 30 was measured, and the grease leakage ratio was calculated according to the following equation.

[Grease Leakage Ratio (%)]=[Leaked grease amount (g)]/[filled grease amount (=270.75 g)]×100

TABLE 3

| | | | Example 1 | Example 2 | Example 3 | Example 4 | Example 5 |
|---|---|---|---|---|---|---|---|
| Formulation of Mixed Grease | Grease (α1) | part by mass | 87.0 | 85.0 | 80.0 | 75.0 | 70.0 |
| | Grease (α2) | part by mass | — | — | — | — | — |
| | Grease (α3) | part by mass | — | — | — | — | — |
| | Grease (α4) | part by mass | — | — | — | — | — |
| | Grease (β1) | part by mass | 3.0 | 5.0 | 10.0 | 15.0 | 20.0 |
| | Grease (β2) | part by mass | — | — | — | — | — |
| | Grease (β3) | part by mass | — | — | — | — | — |
| | Extreme Pressure Agent | part by mass | 10.0 | 10.0 | 10.0 | 10.0 | 10.0 |
| | Total | part by mass | 100.0 | 100.0 | 100.0 | 100.0 | 100.0 |
| Properties of Mixed Grease | Worked Penetration | — | 374 | 379 | 372 | 372 | 368 |
| | 40° C. Kinematic Viscosity of Liquid Component in Mixed Grease | $mm^2/s$ | 83 | 84 | 83 | 83 | 83 |
| | Shell Wear Amount | mm | 0.49 | 0.48 | 0.49 | 0.48 | 0.48 |
| | Shell EP (WL) | N | 2452 | 2452 | 2452 | 2452 | 2452 |
| | Torque Transmission Efficiency | % | 92 | 93 | 88 | 85 | 78 |
| | Grease Leakage Rate | % | 0.2 | 0.2 | 0.2 | 0.2 | 0.3 |

| | | | Example 6 | Example 7 | Example 8 | Example 9 |
|---|---|---|---|---|---|---|
| Formulation of Mixed Grease | Grease (α1) | part by mass | 70.0 | 85.0 | 85.0 | — |
| | Grease (α2) | part by mass | — | — | — | — |
| | Grease (α3) | part by mass | — | — | — | — |
| | Grease (α4) | part by mass | — | — | — | 85.0 |
| | Grease (β1) | part by mass | 10.0 | — | — | 5.0 |
| | Grease (β2) | part by mass | 10.0 | 5.0 | — | — |
| | Grease (β3) | part by mass | — | — | 5.0 | — |
| | Extreme Pressure Agent | part by mass | 10.0 | 10.0 | 10.0 | 10.0 |
| | Total | part by mass | 100.0 | 100.0 | 100.0 | 100.0 |
| Properties of Mixed Grease | Worked Penetration | — | 366 | 380 | 380 | 380 |
| | 40° C. Kinematic Viscosity of Liquid Component in Mixed Grease | $mm^2/s$ | 112 | 96 | 83 | 125 |
| | Shell Wear Amount | mm | 0.49 | 0.50 | 0.49 | 0.49 |
| | Shell EP (WL) | N | 2452 | 2452 | 2452 | 2452 |
| | Torque Transmission Efficiency | % | 72 | 90 | 91 | 87 |
| | Grease Leakage Rate | % | 0.2 | 0.2 | 1.7 | 1.2 |

TABLE 4

| | | | Comparative Example 1 | Comparative Example 2 | Comparative Example 3 | Comparative Example 4 | Comparative Example 5 | Comparative Example 6 |
|---|---|---|---|---|---|---|---|---|
| Formulation of Grease | Grease (α1) | part by mass | 90.0 | — | — | — | — | — |
| | Grease (α2) | part by mass | — | 90.0 | — | — | — | — |
| | Grease (α3) | part by mass | — | — | 90.0 | — | — | — |
| | Grease (α4) | part by mass | — | — | — | 90.0 | — | — |
| | Grease (β1) | part by mass | — | — | — | — | 90.0 | — |
| | Grease (β2) | part by mass | — | — | — | — | — | — |

TABLE 4-continued

| | | | Comparative Example 1 | Comparative Example 2 | Comparative Example 3 | Comparative Example 4 | Comparative Example 5 | Comparative Example 6 |
|---|---|---|---|---|---|---|---|---|
| | Grease (β3) | part by mass | — | — | — | — | — | 90.0 |
| | Extreme Pressure Agent | part by mass | 10.0 | 10.0 | 10.0 | 10.0 | 10.0 | 10.0 |
| | Total | part by mass | 100.0 | 100.0 | 100.0 | 100.0 | 100.0 | 100.0 |
| Properties of Grease | Worked Penetration | — | 376 | 381 | 394 | 380 | 371 | 364 |
| | 40° C. Kinematic Viscosity of Liquid Component in Grease | $mm^2/s$ | 83 | 87 | 84 | 340 | 84 | 365 |
| | Shell Wear Amount | mm | 0.48 | 0.50 | 0.52 | 0.49 | 0.49 | 0.51 |
| | Shell EP (WL) | N | 2452 | 2452 | 1961 | 2452 | 2452 | 2452 |
| | Torque Transmission Efficiency | % | 89 | 82 | 78 | 84 | 77 | 72 |
| | Grease Leakage Rate | % | 2.7 | 3.9 | 56 | 2.2 | 2.1 | 3.2 |

As in Table 3, the mixed greases produced in Examples 1 to 9 have a low grease leakage ratio and have excellent grease leakage preventing properties and, in addition, these have a small Shell wear amount and a high Shell EP value, that is, these are excellent in wear resistance an load bearing properties. In addition, the torque transmission efficiency of these mixed greases are relatively good.

On the other hand, as in Table 4, the greases produced in Comparative Examples 1 to 6 have a higher grease leakage ratio than in Examples.

REFERENCE SIGNS LIST

1 Measurement Device
11 Input Side Motor Part
12 Input Side Torque Meter
13 Input Side Reducer
21 Output Side Motor Part
22 Output Side Torque Meter
23 Output Side Reducer
30 Tray

The invention claimed is:

1. A mixed grease, comprising:

(A) a grease prepared from a base oil (a1) and a thickening agent (a2) that is a lithium soap comprising a lithium salt of a monovalent fatty acid, wherein the thickening agent (a2) comprises a lithium salt of hydroxystearic acid, and a content ratio [(a2)/(a1)] of the thickening agent (a2) to the base oil (a1) contained in the grease (A) is, as a ratio by mass, 3/97 to 10/90; and (B) a grease prepared from a base oil (b1) and a thickening agent (b2) that is a lithium complex soap comprising a lithium salt of a monovalent fatty acid and a lithium salt of a divalent fatty acid, wherein the thickening agent (b2) comprises a lithium salt of hydroxystearic acid and a lithium salt of azelaic acid, and a content ratio [(b2)/(b1)] of the thickening agent (b2) to the base oil (b1) contained in the grease (B) is, as a ratio by mass, 10/90 to 16/84.

2. The mixed grease according to claim 1, wherein a content of the grease (B) is, based on a total amount of the mixed grease, 2.5% by mass or more and 30% by mass or less.

3. The mixed grease according to claim 1, wherein a content ratio [(A)/(B)] of the grease (A) to the grease (B) is, as a ratio by mass, 60/40 or more and 99/1 or less.

4. The mixed grease according to claim 1, wherein a content of the grease (A) is, based on a total amount of the mixed grease, 60% by mass or more and 97.5% by mass or less.

5. The mixed grease according to claim 1, wherein a total content of the base oil (a1) and the thickening agent (a2) constituting the grease (A) and the base oil (b1) and the thickening agent (b2) constituting the grease (B) is, based on a total amount of the mixed grease, 70% by mass or more.

6. The mixed grease according to claim 1, wherein a content ratio [(a2)/(a1)] of the thickening agent (a2) to the base oil (a1) contained in the grease (A) is, as a ratio by mass, 3/97 to 15/85.

7. The mixed grease according to claim 1, wherein a content ratio [(b2)/(b1)] of the thickening agent (b2) to the base oil (b1) contained in the grease (B) is, as a ratio by mass, 10/90 to 30/70.

8. The mixed grease according to claim 1, wherein an average aspect ratio of the thickening agent (a2) and the average aspect ratio of the thickening agent (b2) each independently is 30 or more.

9. The mixed grease according to claim 1, further comprising:

at least one extreme pressure agent selected from the group consisting of a molybdenum-based extreme pressure agent, a phosphorus-based extreme pressure agent, and a sulfur/phosphorus-based extreme pressure agent.

10. The mixed grease according to claim 1, which has a worked penetration at 25° C. of 310 to 430.

11. The mixed grease according to claim 1, wherein the lithium soap consists of the lithium salt of a monovalent fatty acid and the lithium salt of a divalent fatty acid.

12. The mixed grease according to claim 1, wherein the lithium complex soap consists of the lithium salt of a monovalent fatty acid and the lithium salt of a divalent fatty acid and the lithium salt of a divalent fatty acid.

13. The mixed grease according to claim 1, having a grease leakage ratio of 2.0% or less.

14. The mixed grease according to claim 1, having a grease leakage ratio of 0.5% or less.

15. The mixed grease according to claim 14, wherein the grease prepared from the base oil (a1) is present in an amount of from 70 to 87 parts by mass and the grease prepared from the base oil (b1) is present in an amount of 3-20 parts by mass.

16. A mixed grease comprising:

(A) a grease prepared from a base oil (a1) and a thickening agent (a2) that is a lithium soap comprising a lithium salt of a monovalent fatty acid, wherein the thickening agent (a2) comprises a lithium salt of hydroxystearic acid, and a content ratio [(a2)/(a1)] of the thickening agent (a2) to the base oil (a1) contained in the grease (A) is, as a ratio by mass, 3/97 to 10/90; and (B) a grease prepared from a base oil (b1) and a thickening agent (b2) that is a lithium complex soap comprising a lithium salt of a monovalent fatty acid and a lithium salt of a divalent fatty acid.

17. A mixed grease comprising:

(A) a grease prepared from a base oil (a1) and a thickening agent (a2) that is a lithium soap comprising a lithium salt of a monovalent fatty acid; and (B) a grease prepared from a base oil (b1) and a thickening agent (b2) that is a lithium complex soap comprising a lithium salt of a monovalent fatty acid and a lithium salt of a divalent fatty acid, wherein the thickening agent (b2) comprises a lithium salt of hydroxystearic acid and a lithium salt of azelaic acid, and a content ratio [(b2)/(b1)] of the thickening agent (b2) to the base oil (b1) contained in the grease (B) is, as a ratio by mass, 10/90 to 16/84.

18. The mixed grease according to claim 15, having a shell wear amount according to ASTMD 2783 of 0.5 mm or less.

19. The mixed grease according to claim 15, having a torque transmission efficiency of 90% or greater.

20. The mixed grease according to claim 1, wherein the grease prepared from the base oil (a1) consists of the base oil (a1) and the thickening agent (a2), and the grease prepared from the base oil (b1) consists of the base oil (b1) and the thickener (b2).

* * * * *